US006242857B1

(12) United States Patent
Hashimoto et al.

(10) Patent No.: US 6,242,857 B1
(45) Date of Patent: Jun. 5, 2001

(54) HIGH EFFICIENCY FLUORESCENT LAMP WITH LOW COLOR RENDERING PROPERTY

(75) Inventors: Kenjiro Hashimoto, Osaka; Tadashi Yano, Kyoto; Masanori Shimizu, Kyotanabe; Syouetsu Sakamoto, Hirakata, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/180,596

(22) PCT Filed: Mar. 6, 1998

(86) PCT No.: PCT/JP98/00942

§ 371 Date: Nov. 10, 1998

§ 102(e) Date: Nov. 10, 1998

(87) PCT Pub. No.: WO98/40908

PCT Pub. Date: Sep. 17, 1998

(30) Foreign Application Priority Data

Mar. 10, 1997 (JP) ..... 9-054531

(51) Int. Cl.[7] ..... H01J 63/04

(52) U.S. Cl. ..... 313/485; 313/486; 252/301.4 H

(58) Field of Search ..... 313/485, 486, 313/487, 467, 468; 252/301.4 F, 301.4 H, 301.4 R, 301.4 P; 427/67

(56) References Cited

U.S. PATENT DOCUMENTS 5,714,836 * 2/1998 Hunt et al. ..... 313/487

FOREIGN PATENT DOCUMENTS

| | | |
|---|---|---|
| 794556 | 9/1997 | (EP) . |
| 58-225552 | 12/1983 | (JP) . |
| 64-2246 | 1/1989 | (JP) . |
| 64002246 | 1/1989 | (JP) . |
| 02098035 | 4/1990 | (JP) . |
| 10-21883 | 1/1998 | (JP) . |
| 10021883 | 1/1998 | (JP) . |
| 10-112286 | 4/1998 | (JP) . |
| 10-116589 | 5/1998 | (JP) . |
| 10-116592 | 5/1998 | (JP) . |
| 10116589 | 5/1998 | (JP) . |
| WO 97/11480 | 3/1997 | (WO) . |

OTHER PUBLICATIONS

Japanese language search report for Inl'l Appln No. PCT/JP98/00942 dated Jul. 1998.

English translation of Japanese language search report.

* cited by examiner

*Primary Examiner*—Nimeshkumar D. Patel
*Assistant Examiner*—Joseph Williams
(74) *Attorney, Agent, or Firm*—Ratner & Prestia

(57) ABSTRACT

A fluorescent lamp which produces primary light using a green emission phosphor with a peak emission wavelength at 530 nm to 560 nm and a red emission phosphor with a peak emission wavelength at 600 nm to 630 nm, is characterized in that, under illumination by said fluorescent lamp, four test colors for special color rendering index calculation, No. 9, No. 10, No. 11, and No. 12, specified in the Commission Internationale de l'Eclairage CIE Publication No. 13.3, are perceivable as red, yellow, green, and purplish blue, respectively, in terms of Munsell hues.

24 Claims, 4 Drawing Sheets

HIGH EFFICIENCY FLUORESCENT LAMP WITH LOW COLOR RENDERING PROPERTY

This application is a U.S. National Phase application of PCT International application PCT/JP97/00942.

TECHNICAL FIELD

The present invention relates to a fluorescent lamp that has low color rendering property but has high lamp efficacy.

BACKGROUND ART

Discharge lamps that utilize the phenomenon of discharge occurring within an arc tube are classified into two types: high-intensity discharge lamps and fluorescent lamps. High-intensity discharge lamps have high lamp efficacy, produce bright light, have long life, and are, therefore, highly economical lamps. Because of these advantages, high-intensity discharge lamps are widely used in outdoor lighting applications which require bright illumination over a large area.

Of such high-intensity discharge lamps, the lamp that has the highest lamp efficacy is the low-pressure sodium lamp. Low-pressure sodium lamps are therefore used in places where economy is of importance, typical applications including tunnel illumination. However, since low-pressure sodium lamps are lamps that utilize discharge in a sodium vapor, they produce monochromatic orange-yellow light near 590 nm. The result is that colors of objects illuminated by low-pressure sodium lamps are hardly recognizable.

Because of the monochromatic radiation, the low-pressure sodium lamp has had a number of problems; for example, in a tunnel, it is difficult to discern whether the color of lane-dividing lines pained on the road is white or yellow, leaving drivers unable to determine whether changing lanes is permitted or not, or almost all objects appear lacking in color and unnatural to viewers.

On the other hand, of discharge lamps, the fluorescent lamp has many advantages over other types of lamp, such as ease of lighting, excellent color rendering property, long life, and an abundant selection of light colors, and large numbers of fluorescent lamps are used in a variety of fields.

Of various types of fluorescent lamps, three band fluorescent lamps, among others, have come into wide use in recent years. The three band type fluorescent lamp produces light predominantly in three wavelength regions where the human eye is most sensitive to color perception, that is, blue at about 450 nm, green at about 540 nm, and red at about 610 nm, and thus provides good color rendering property without sacrificing brightness.

With the widespread use of the three band fluorescent lamp, one improvement after another have been made to three narrow band radiation phosphors used in the three band type fluorescent lamp. Consequently, these phosphors have excellent characteristics, such as high quantum efficiency, compared with other phosphors. Of the three narrow band radiation phosphors, the mono-phosphor green fluorescent lamp using a green phosphor expressed by the chemical formula $LaPO_4$: $Ce^{3+}$,$Tb^{3+}$, among others, has a lamp efficacy as high as about 140 lm/W in high frequency operating; its overall efficacy including the lighting circuit efficiency of lighting fixture, that is, its luminous efficacy including gear losses is about 130 lm/W. Of all the present fluorescent lamps, this fluorescent lamp has the highest luminous efficacy including gear losses. This has raised the potential for developing fluorescent lamps having high efficacy.

DISCLOSURE OF THE INVENTION

In view of the above situation, it is an object of the present invention to provide a fluorescent lamp having efficacy comparable to or higher than that of the low-pressure sodium lamp and yet capable of providing minimum required color recognizability.

One aspect of the present invention is a fluorescent lamp which produces primary light using a green emission phosphor with a peak emission wavelength at 530 nm to 560 nm and a red emission phosphor with a peak emission wavelength at 600 nm to 630 nm, characterized in that, under illumination by said fluorescent lamp, four test colors for special color rendering index calculation, No. 9, No. 10, No. 11, and No. 12, specified in the Commission Internationale de l'Eclairage CIE Publication No. 13.3, are perceivable as red, yellow, green, and purplish blue, respectively, in terms of Munsell hues.

Another aspect of the present invention is a fluorescent lamp, wherein the correlated color temperature of said fluorescent lamp is 3200 K to 4500 K, and the chromaticity point of said light color is located within a chromaticity range where the distance of color point from Planckian locus on the CIE 1960 uv chromaticity diagram is not less than 0.015 and not greater than 0.045.

Still another aspect of the present invention is a fluorescent lamp, wherein said green emission phosphor is a rare earth phosphor activated with terbium, terbium cerium, or terbium gadolinium cerium, and said red emission phosphor is a rare earth phosphor activated with europium.

A further aspect of the present invention is a fluorescent lamp, wherein the ratio of said green emission phosphor to said red phosphor is 70:30 to 50:50 by weight percent.

A still further aspect of the present invention is a fluorescent lamp, wherein said fluorescent lamp is used in outdoor lighting applications.

Yet another aspect of the present invention is a fluorescent lamp, wherein said fluorescent lamp is used in roadway lighting and tunnel lighting applications.

BEST MODE FOR CARRYING OUT THE INVENTION

Figure 1:
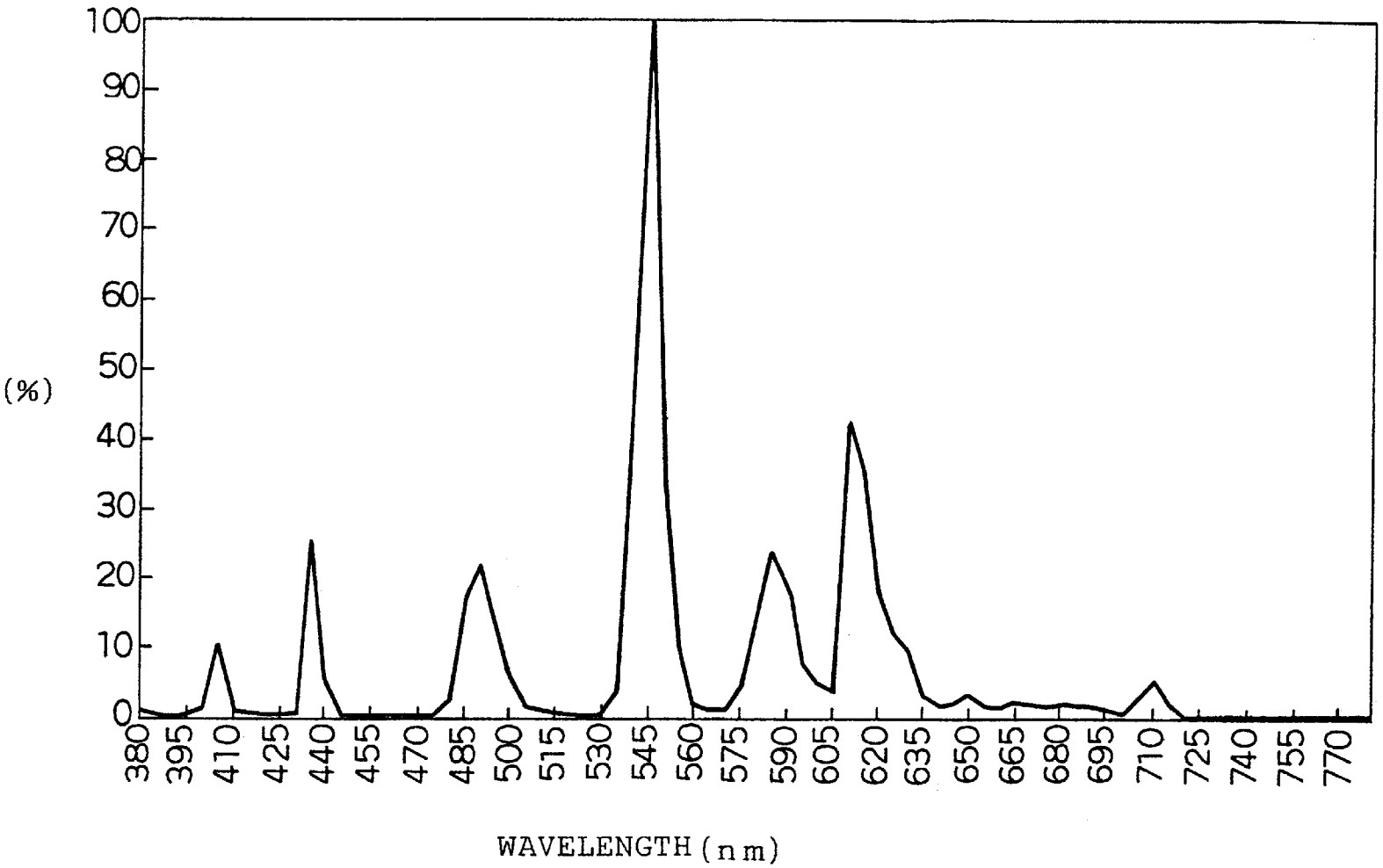
FIG. 1 is a relative spectral distribution diagram for a fluorescent lamp according to one embodiment of the present invention.

Basic considerations in developing a fluorescent lamp that has high luminous efficacy including gear losses and has low color rendering property, for example, minimum required color rendering property, will be described first.

To increase the luminous efficacy including gear losses, that is, the lamp efficacy, of a fluorescent lamp, it is effective to use a phosphor having a high luminous efficacy.

Therefore, it is effective to use at least a green emission phosphor, such as the one expressed by the chemical formula $LaPO_4$: $Ce^{3+}$,$Tb^{3+}$, which is used in three band type fluorescent lamps and is presently the highest in efficacy, as previously described.

Next, to effectively provide the minimum required color rendering property, it is important to decide what other phosphors are to be used and in what proportions.

The operating principle of a fluorescent lamp is such that the mercury contained in the tube produces mercury line spectra and the phosphor excited by the mercury line spectra emits light.

Accordingly, the light emitted from the fluorescent lamp is a blend of the light emitted from the phosphor and the light in the visible mercury line spectra. The visible mercury line spectra are particularly prominent in shorter wavelength regions at 405 nm, 436 nm, etc., and it is said that the amount of visible mercury line spectra contained in a fluorescent lamp is about 5 1m/W.

Therefore, a fluorescent lamp, by its nature, produces somewhat bluish light. It should be noted here that blue radiation improves the color rendering property if added in small amounts, that the luminous efficacy of a blue emission phosphor is considerably lower than the luminous efficacy of green and red emission phosphors, and that letters and pictorial symbols of red and similar colors are used for danger warning signs. For these and other reasons, it is desirable not to use blue phosphors.

From the above, it can be seen that it is desirable to use a red phosphor and a green phosphor in appropriate proportions.

As already proved with three band type fluorescent lamps, a phosphor having an emission peak in the range of 600 nm to 630 nm, centered around the wavelength of about 610 nm where humans perceive color efficiently, should be used as the red phosphor.

Further, there arises the problem of in what ratio the green and red phosphors should be mixed for the minimum required color rendering property.

The colorimetric calculation method to find the optimum mixing ratio was determined in the following manner.

That is, at least for basic colors, the colors of an object must be perceived nearly the same as the original colors of the object. For the color perception, the state of chromatic adaptation of the human eye must be considered. The original colors of an object mean the colors observed under a standard illuminant under which we usually see objects. In perceiving the colors of an object, hue is the most important factor. These and other points were considered.

From the above point, test colors for special color rendering index evaluation, No. 9, No. 10, No. 11, and No. 12, specified in the Commission Internationale de l'Eclairage (CIE) Publication No. 13.3 incorporated by referance herein were used as the basic colors.

These test colors are the high saturation four test colors selected for the evaluation of the color rendering properties of light sources in Japan and in other countries of the world. Spectral radiance factors of the four test colors are shown in Table 1.

Spectral Radiance Factors of Four Test Colors No. 9 to No. 12 in CIE 13.2-1974

[TABLE 1]

| ① | Test Color | | | |
|---|---|---|---|---|
| (nm) | NO. 9 | NO. 10 | NO. 11 | NO. 12 |
| 380 | 0.066 | 0.050 | 0.111 | 0.120 |
| 385 | 0.062 | 0.054 | 0.121 | 0.103 |
| 390 | 0.058 | 0.059 | 0.127 | 0.090 |
| 395 | 0.055 | 0.063 | 0.129 | 0.082 |
| 400 | 0.052 | 0.066 | 0.127 | 0.076 |
| 405 | 0.052 | 0.067 | 0.121 | 0.068 |
| 410 | 0.051 | 0.068 | 0.116 | 0.064 |
| 415 | 0.050 | 0.069 | 0.112 | 0.065 |
| 420 | 0.050 | 0.069 | 0.108 | 0.075 |
| 425 | 0.049 | 0.070 | 0.105 | 0.093 |
| 430 | 0.048 | 0.072 | 0.104 | 0.123 |
| 435 | 0.047 | 0.073 | 0.104 | 0.160 |
| 440 | 0.046 | 0.076 | 0.105 | 0.207 |
| 445 | 0.044 | 0.078 | 0.106 | 0.256 |
| 450 | 0.042 | 0.083 | 0.110 | 0.300 |
| 455 | 0.041 | 0.088 | 0.115 | 0.331 |
| 460 | 0.038 | 0.095 | 0.123 | 0.346 |
| 465 | 0.035 | 0.103 | 0.134 | 0.347 |
| 470 | 0.033 | 0.113 | 0.148 | 0.341 |
| 475 | 0.031 | 0.125 | 0.167 | 0.328 |
| 480 | 0.030 | 0.142 | 0.192 | 0.307 |
| 485 | 0.029 | 0.162 | 0.219 | 0.282 |
| 490 | 0.028 | 0.189 | 0.252 | 0.257 |
| 495 | 0.028 | 0.219 | 0.291 | 0.230 |
| 500 | 0.028 | 0.262 | 0.325 | 0.204 |
| 505 | 0.029 | 0.305 | 0.347 | 0.178 |
| 510 | 0.030 | 0.365 | 0.356 | 0.154 |
| 515 | 0.030 | 0.416 | 0.353 | 0.129 |
| 520 | 0.031 | 0.465 | 0.346 | 0.109 |
| 525 | 0.031 | 0.509 | 0.333 | 0.090 |
| 530 | 0.032 | 0.546 | 0.314 | 0.075 |
| 535 | 0.032 | 0.581 | 0.294 | 0.062 |
| 540 | 0.033 | 0.610 | 0.271 | 0.051 |
| 545 | 0.034 | 0.634 | 0.248 | 0.041 |
| 550 | 0.035 | 0.653 | 0.227 | 0.035 |
| 555 | 0.037 | 0.666 | 0.206 | 0.029 |
| 560 | 0.041 | 0.678 | 0.188 | 0.025 |
| 565 | 0.044 | 0.687 | 0.170 | 0.022 |
| 570 | 0.048 | 0.693 | 0.153 | 0.019 |
| 575 | 0.052 | 0.698 | 0.138 | 0.017 |
| 580 | 0.060 | 0.701 | 0.125 | 0.017 |
| 585 | 0.076 | 0.704 | 0.114 | 0.017 |
| 590 | 0.102 | 0.705 | 0.106 | 0.016 |
| 595 | 0.136 | 0.705 | 0.100 | 0.016 |
| 600 | 0.190 | 0.706 | 0.096 | 0.016 |
| 605 | 0.256 | 0.707 | 0.092 | 0.016 |
| 610 | 0.336 | 0.707 | 0.090 | 0.016 |
| 615 | 0.418 | 0.707 | 0.087 | 0.016 |
| 620 | 0.505 | 0.708 | 0.085 | 0.016 |
| 625 | 0.581 | 0.708 | 0.082 | 0.016 |
| 630 | 0.641 | 0.710 | 0.080 | 0.018 |
| 635 | 0.682 | 0.711 | 0.079 | 0.018 |
| 640 | 0.717 | 0.712 | 0.078 | 0.018 |
| 645 | 0.740 | 0.714 | 0.078 | 0.018 |
| 650 | 0.758 | 0.716 | 0.078 | 0.019 |
| 655 | 0.770 | 0.718 | 0.078 | 0.020 |
| 660 | 0.781 | 0.720 | 0.081 | 0.023 |
| 665 | 0.790 | 0.722 | 0.083 | 0.024 |
| 670 | 0.797 | 0.725 | 0.088 | 0.026 |
| 675 | 0.803 | 0.729 | 0.093 | 0.030 |
| 680 | 0.809 | 0.731 | 0.102 | 0.035 |
| 685 | 0.814 | 0.735 | 0.112 | 0.043 |
| 690 | 0.819 | 0.739 | 0.125 | 0.056 |
| 695 | 0.824 | 0.742 | 0.141 | 0.074 |
| 700 | 0.828 | 0.746 | 0.161 | 0.097 |
| 705 | 0.830 | 0.748 | 0.182 | 0.128 |
| 710 | 0.831 | 0.749 | 0.203 | 0.166 |
| 715 | 0.833 | 0.751 | 0.223 | 0.210 |
| 720 | 0.835 | 0.753 | 0.242 | 0.257 |
| 725 | 0.836 | 0.754 | 0.257 | 0.305 |
| 730 | 0.836 | 0.755 | 0.270 | 0.354 |
| 735 | 0.837 | 0.755 | 0.282 | 0.401 |
| 740 | 0.838 | 0.755 | 0.292 | 0.446 |

-continued

| ① (nm) | Test Color NO. 9 | NO. 10 | NO. 11 | NO. 12 |
|---|---|---|---|---|
| 745 | 0.839 | 0.755 | 0.302 | 0.485 |
| 750 | 0.839 | 0.756 | 0.310 | 0.520 |
| 755 | 0.839 | 0.757 | 0.314 | 0.551 |
| 760 | 0.839 | 0.758 | 0.317 | 0.577 |
| 765 | 0.839 | 0.759 | 0.323 | 0.599 |
| 770 | 0.839 | 0.759 | 0.330 | 0.618 |
| 775 | 0.839 | 0.759 | 0.334 | 0.633 |
| 780 | 0.839 | 0.759 | 0.338 | 0.645 |

① Wavelength λ

To predict the state of chromatic adaptation, the CIE colorimetric adaptation transform given in CIE 109-1994 was used, and the CIE standard illuminant C was used as the standard reference illuminant. Further, for the hue used for object color perception, the Munsell hue in the Munsell color system was used.

The Munsell color system and the Munsell hue will be described briefly below.

The Munsell color system, devised by an American painter A. H. Munsell, is a system for classifying and arranging colors based on three attributes, i.e., the Munsell hue, the Munsell value (lightness), and the Munsell chroma.

The Munsell hue is defined on a scale of a total of 100 hues; that is, 10 hues consisting of five basic hues of R, Y, G, B, and P and their intermediate hues YR, GY, BG, PB, and RP are arranged at equal intervals along a circle, and each of the 10 hue intervals is further divided into 10 equal parts, thus defining the 100 hues having psychologically equal hue differences.

Prior to the colorimetric calculation, a 40 W mono-phosphor fluorescent lamp consisting of a linear tube was produced to obtain the spectral distribution of the lamp that serves as the basis for the colorimetric calculation. The phosphor expressed by the chemical formula $LaPO_4$: $Ce^{3+}$, $Tb^{3+}$, proven in three band type fluorescent lamps, was used for the mono-phosphor green fluorescent lamp. For the mono-phosphor red fluorescent lamp, a phosphor expressed by the chemical formula $Y_2O_3$: $Eu^{3+}$, also proven in three band type fluorescent lamps, was used.

Next, the spectral distribution and total luminous flux of each of the mono-phosphor green and mono-phosphor red fluorescent lamps were measured.

Based on the obtained spectral distributions, the luminous flux ratio between the two fluorescent lamps was varied and the spectral distributions of various blended lights were calculated by light blending calculations.

Figure 2:
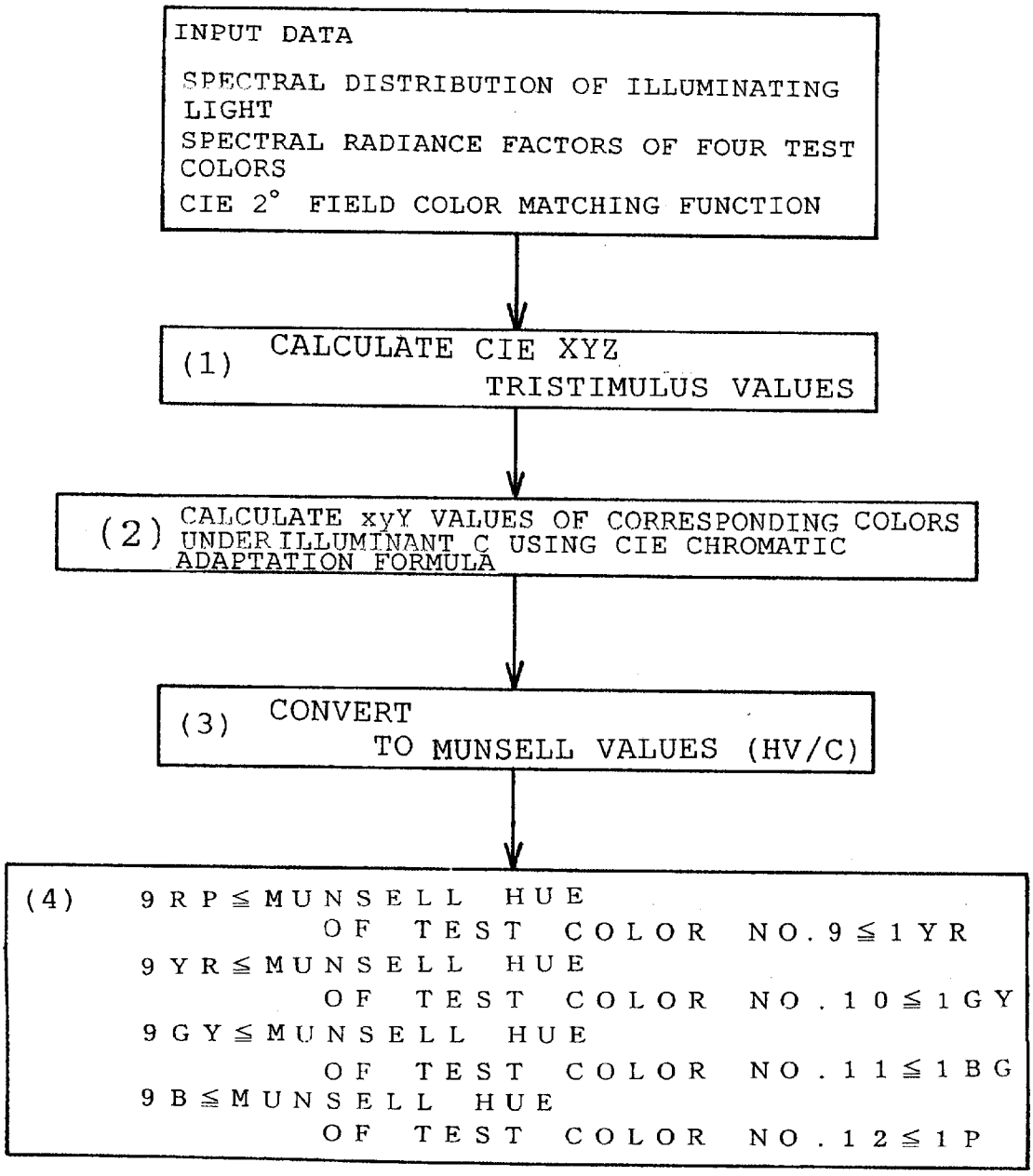
FIG. 2 is a diagram for explaining a method of evaluating color characteristics according to the present invention.

Using the spectral distribution of each blended light thus calculated, the characteristics of the fluorescent lamp having the minimum required color rendering property were studied using the calculation method shown in FIG. 2 which illustrates an example of the colorimetric calculation.

First, the spectral distribution of the illuminating light, the spectral radiance factors of the four test colors, and the CIE 2° field color matching function are input.

(1) CIE XYZ tristimulus values are calculated from the thus calculated spectral distribution of each illuminating light, the spectral radiance factors of the four test colors specified in the CIE Publication No. 13.3 shown in Table 1, and the CIE 2° field color matching function.

(2) Under standard conditions in which the CIE standard illuminant C is used as the standard reference light, the illuminance of each illuminating light and the standard reference light is 1000 lx, and the reflectance of the background is 20%, the xyY values of corresponding colors under the standard illuminant C are obtained using the CIE chromatic adaptation transform.

(3) Next, the xyY values under the standard illuminant C are converted into corresponding Munsell values (HV/C).

The Munsell values (HV/C) of the four test colors under the various illuminating lights are shown in Table 2 for each test color.

TABLE 2

| ① | ② | Munsell Hue H | Munsell Value V | Munsell Chroma C |
|---|---|---|---|---|
| | | Test Color No. 9 | | |
| No. 1 | G:R = 10:0 | 5.2 RP | 2.9 | 9.7 |
| No. 2 | G:R = 9:1 | 7.9 RP | 3.4 | 11.3 |
| No. 3 | G:R = 8:2 | 9.7 RP | 3.8 | 12 |
| No. 4 | G:R = 7:3 | 1.3 R | 4.1 | 12.2 |
| No. 5 | G:R = 6:4 | 2.9 R | 4.4 | 12 |
| No. 6 | G:R = 5:5 | 4.3 R | 4.7 | 11.5 |
| No. 7 | G:R = 4:6 | 6.0 R | 5 | 10.9 |
| No. 8 | G:R = 3:7 | 7.8 R | 5.2 | 10.2 |
| No. 9 | G:R = 2:8 | 9.7 R | 5.4 | 9.5 |
| No. 10 | G:R = 1:9 | 2.2 YR | 5.7 | 8.8 |
| No. 11 | G:R = 0.10 | 4.9 YR | 5.9 | 8.2 |
| | ③ | 5.0 R | 3.9 | 13.4 |
| | | Test Color No. 10 | | |
| No. 1 | G:R = 10:0 | 3.8 GY | 8.2 | 8.9 |
| No. 2 | G:R = 9:1 | 1.9 GY | 8.2 | 8.8 |
| No. 3 | G:R = 8:2 | 0.2 GY | 8.3 | 8.8 |
| No. 4 | G:R = 7:3 | 8.1 Y | 8.3 | 9 |
| No. 5 | G:R = 6:4 | 6.3 Y | 8.3 | 9.3 |
| No. 6 | G:R = 5:5 | 4.9 Y | 8.4 | 9.7 |
| No. 7 | G:R = 4:6 | 4.1 Y | 8.4 | 10.2 |
| No. 8 | G:R = 3:7 | 3.4 Y | 8.4 | 10.6 |
| No. 9 | G:R = 2:8 | 2.8 Y | 8.5 | 11 |
| No. 10 | G:R = 1:9 | 1.5 Y | 8.5 | 12 |
| No. 11 | G:R = 0:10 | 1.0 Y | 8.5 | 13 |
| | ③ | 5.2 Y | 8 | 10.1 |
| | | Test Color No. 11 | | |
| No. 1 | G:R = 10:0 | 4.8 G | 5.3 | 3.5 |
| No. 2 | G:R = 9:1 | 7.3 G | 5.1 | 4.7 |
| No. 3 | G:R = 8:2 | 8.8 G | 5 | 5.7 |
| No. 4 | G:R = 7:3 | 9.8 G | 4.9 | 6.6 |
| No. 5 | G:R = 6:4 | 0.6 BG | 4.8 | 7.2 |
| No. 6 | G:R = 5:5 | 1.2 BG | 4.6 | 7.7 |
| No. 7 | G:R = 4:6 | 1.8 BG | 4.5 | 7.9 |
| No. 8 | G:R = 3:7 | 2.4 BG | 4.4 | 7.9 |
| No. 9 | G:R = 2:8 | 3.0 BG | 4.2 | 7.5 |
| No. 10 | G:R = 1:9 | 4.0 BG | 4.1 | 6.7 |
| No. 11 | G:R = 0:10 | 5.5 BG | 3.9 | 5.6 |
| | ③ | 4.8 G | 5 | 7.8 |
| | | Test Color No. 12 | | |
| No. 1 | G:R = 10:0 | 8.6 PB | 2.6 | 11.3 |
| No. 2 | G:R = 9:1 | 7.6 PB | 2.5 | 11.1 |
| No. 3 | G:R = 8:2 | 6.9 PB | 2.4 | 11.2 |
| No. 4 | G:R = 7:3 | 6.3 PB | 2.3 | 11.2 |
| No. 5 | G:R = 6:4 | 5.9 PB | 2.2 | 11.4 |
| No. 6 | G:R = 5:% | 5.6 PB | 2.1 | 11.5 |
| No. 7 | G:R = 4:6 | 5.4 PB | 2.1 | 11.8 |
| No. 8 | G:R = 3:7 | 5.3 PB | 2 | 11.9 |
| No. 9 | G:R = 2:8 | 5.3 PB | 1.8 | 12.2 |
| No. 10 | G:R = 1:9 | 5.4 PB | 1.7 | 12.7 |
| No. 11 | G:R = 0:10 | 5.6 PB | 1.6 | 13 |
| | ③ | 3.3 PB | 3 | 10.7 |

①: Illuminating Light
②: Luminous Flux Ratio Green (G), Red (R),
③: Standard Illuminant C As shown in Table 2, of the four test colors in the CIE Publication No. 13.3, the test color No. 9, under the standard illuminant, has a Munsell hue of 5.0 R, a Munsell yellow hue of 5.2 Y, a Munsell green hue of 4.8 G, and a Munsell blue hue of 3.3 PB.

Therefore, under the standard illuminant, the hues of the four test colors are substantially centralized in the red region designated R in the Munsell hue, the yellow region designated Y in the Munsell hue, the green region designated G in the Munsell hue, and the purplish blue region designated PB in the Munsell hue, of the 10 hue regions in the Munsell hue circle.

Further, under the standard illuminant, most individuals cannot differentiate colors when the color difference CIE 1976 ΔEab*=1.2, and can differentiate colors when ΔEab*=2.5.

Therefore, the resolution of color differentiation in the Munsell hue can be assumed to be a little more than about one unit (H=Δ1.0).

Accordingly, the range in which the test color No. 9 in the CIE Publication No. 13.3 can be substantially perceived as red is from 9 RP through R to 1 YR in the Munsell hue; the range in which the test color No. 10 can be substantially perceived as yellow is from 9 YR through Y to 1 GY in the Munsell hue; the range in which the test color No. 11 can be substantially perceived as green is from 9 GY through G to 1 BG in the Munsell hue; and the range in which the test color No. 12 can be substantially perceived as purplish blue is from 9 B through PB to 1 P in the Munsell hue.

If the Munsell hues of the test colors obtained through the earlier described calculation steps (1) to (3) under each illuminating light are in the above ranges, the test colors should be substantially perceivable as red, yellow, green, and purplish blue, respectively.

Figure 3:
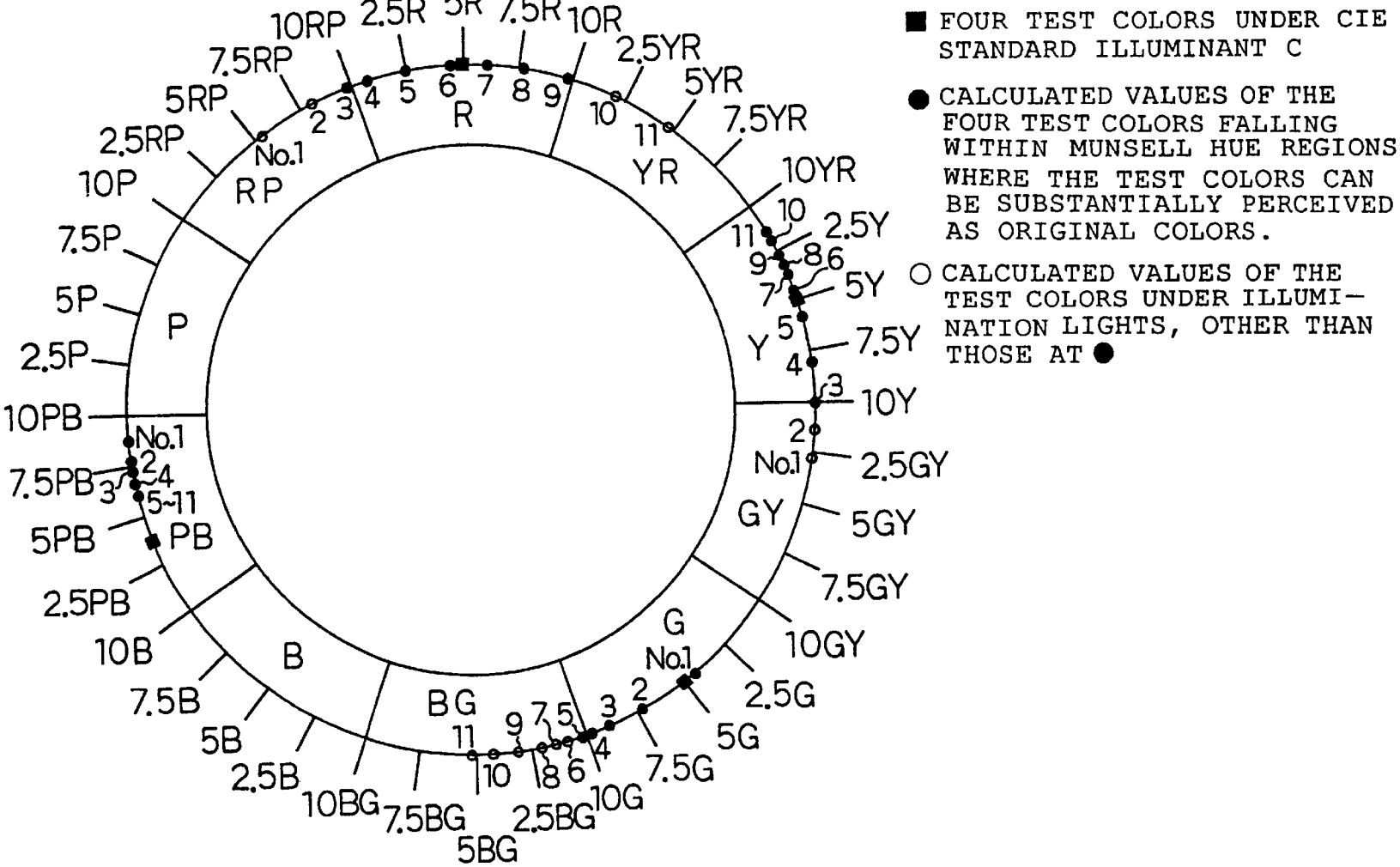
FIG. 3 is a diagram showing the Munsell hue circle which provides the basic concept of the present invention.

The Munsell hue values in Table 1 calculated for the respective test colors under the various illuminating lights are plotted in FIG. 3. In FIG. 3, black squares indicate the four test colors under the CIE standard illuminant C, that is, the colors of the color chips themselves, while black dots indicate the calculated values of the respective test colors which fall within the Munsell hue ranges in which the four test colors can be substantially perceived as their original colors, and white dots indicate the calculated value of the test colors, other than those at the black dots, under the various illuminating lights.

As can be seen from FIG. 3, the illuminating light that substantially renders the test color No. 9 as color in the red region designated R in the Munsell hue, is in the range of about 8:2 to 2:8 in terms of the luminous flux ratio between the mono-phosphor green fluorescent lamp and mono-phosphor red fluorescent lamp. The illuminating light that substantially renders the test color No. 10 as color in the yellow region designated Y in the Munsell hue, is in the range of about 8:2 to 0:10 in terms of the luminous flux ratio between the mono-phosphor green fluorescent lamp and mono-phosphor red fluorescent lamp.

The illuminating light that substantially renders the test color No. 11 as color in the green region designated G in the Munsell hue, is in the range of about 10:0 to 6:4 in terms of the luminous flux ratio between the mono-phosphor green fluorescent lamp and mono-phosphor red fluorescent lamp.

The illuminating light that substantially renders the test color No. 12 as color in the purplish blue region designated PB in the Munsell hue, is in the range of about 10:0 to 0:10 in terms of the luminous flux ratio between the mono-phosphor green fluorescent lamp and mono-phosphor red fluorescent lamp.

Accordingly, the illuminating light that substantially renders the test color No. 9 as color in the red region designated R in the Munsell hue, the test color No. 10 as color in the yellow region designated Y in the Munsell hue, the test color No. 11 as color in the green region designated G in the Munsell hue, and the test color No. 12 as color in the purplish blue region designated PB in the Munsell hue, is in the range of about 8:2 to 6:4 in terms of the luminous flux ratio between the mono-phosphor green fluorescent lamp and mono-phosphor red fluorescent lamp.

In the above calculations, the spectral distributions of the mono-phosphor fluorescent lamps were used, using the phosphor expressed by the chemical formula $LaPO_4$: $Ce^{3+}$, $Tb^{3+}$ as a representative example of the green emission phosphor whose peak emission wavelength is 530 nm to 560 nm, and the phosphor expressed by the chemical formula $Y_2O_3$: $Eu^{3+}$ as a representative example of the red emission phosphor whose peak emission wavelength is 600 nm to 630 nm. However, since the results of the above calculations show in general the results of the calculations for illuminant characteristics performed using the illuminant blending two mono-phosphor fluorescent lamps having the above-stated wavelengths, the results of the above calculations are also valid if phosphors other than those specifically given above are used. That is, the point here is to provide a fluorescent lamp that produces primary light using a green emission phosphor with a peak emission wavelength at 530 nm to 560 nm and a red emission phosphor with a peak emission wavelength at 600 nm to 630 nm.

The characteristics of the various illuminating lights, calculated by varying the luminous flux ratio between the two fluorescent lamps by the above-mentioned light blending calculations, are shown in Table 3. Table 3 shows the illuminating light number, luminous flux ratio, correlated color temperature, chromaticity deviation (hereinafter described as Δuv) of the distance of color point from Planckan locus on the CIE 1960 uv chromaticity diagram, and predicted lamp efficacy, in this order.

TABLE 3

Characteristics of Illuminating Lights

| Illuminating Light | Luminous Flux Ratio Green (G), Red (R) | Correlated Color Temperature | Δ uv | Lamp Efficacy (lm/W) |
|---|---|---|---|---|
| No. 1 | G:R = 10:0 | 5726 | 0.076 | 130 |
| No. 2 | G:R = 9:1 | 4933 | 0.0554 | 125 |
| No. 3 | G:R = 8:2 | 4175 | 0.0356 | 119 |
| No. 4 | G:R = 7:3 | 3466 | 0.019 | 114 |
| No. 5 | G:R = 6:4 | 2852 | 0.0061 | 108 |
| No. 6 | G:R = 5:5 | 2366 | −0.0031 | 103 |
| No. 7 | G:R = 4:6 | 2000 | −0.0091 | 97 |
| No. 8 | G:R = 3:7 | 1725 | −0.0131 | 92 |
| No. 9 | G:R = 2:8 | 1512 | −0.0156 | 86 |
| No. 10 | G:R = 1:9 | 1341 | −0.0172 | 81 |
| No. 11 | G:R = 0:10 | ***** | **** | 75 |

Using Table 3, the correlated color temperature, the chromaticity deviation (Δuv) of the distance of color point from Planckian locus on the CIE 1960 uv chromaticity diagram, and the lamp efficacy were examined in detail for each of the illuminating lights whose luminous flux ratios between the mono-phosphor green and mono-phosphor red fluorescent lamps are 8:2 to 6:4.

The illuminating light when the luminous flux ratio between the mono-phosphor green and mono-phosphor red fluorescent lamps is 8:2 has a correlated color temperature of 4175 K, Δuv of +0.0356, and lamp efficacy of about 120 lm/W. The illuminating light when the luminous flux ratio between the mono-phosphor green and mono-phosphor red fluorescent lamps is 7:3 has a correlated color temperature of 3466 K, Δuv of +0.0189, and lamp efficacy of about 110 lm/W.

Further, the illuminating light when the luminous flux ratio between the mono-phosphor green and mono-phosphor red fluorescent lamps is 6:4 has a correlated color temperature of 2852 K, Δuv of +0.061, and lamp efficacy of about 100 lm/W.

The lamp efficacy of the illuminating light when the luminous flux ratio between the mono-phosphor green and mono-phosphor red fluorescent lamps is 6:4 does not show a significant improvement compared with the lamp efficacy of about 90 lm/W of the presently used 40 W linear tube three band fluorescent lamp.

Accordingly, a fluorescent lamp that has high lamp efficacy and yet provides the minimum required color rendering property can be produced when the luminous flux ratio between the mono-phosphor green and mono-phosphor red fluorescent lamps is in the range of about 8:2 to about 7:3.

In particular, a fluorescent lamp that has the highest lamp efficacy and yet provides the minimum required color rendering property can be produced when the quantity of light from the mono-phosphor green fluorescent lamp is the largest, that is, the ratio of the luminous flux radiated from the mono-phosphor green fluorescent lamp to that from the mono-phosphor red fluorescent lamp is about 8:2.

Referring to Table 3, and considering the fact that the characteristics of the illuminating light vary within a certain range depending on the kinds of the phosphors used, the correlated color temperature and the range of Δuv of the illuminating light of the present invention were determined in the following manner.

The present invention provides a notable effect when the luminous flux ratio between the mono-phosphor green and mono-phosphor red fluorescent lamps is in the range of about 8:2 to about 7:3, but an equivalent effect can also be obtained in a wider range from 9:1 to 6:4.

In view of this, the correlated color temperature, 3150 K, and the chromaticity deviation relative to the Planckian locus, 0.013, were taken as respective values at mid point between the luminous flux ratios 7:3 and 6:4, and the correlated color temperature, 4550 K, and the chromaticity deviation relative to the Planckian locus, 0.045, were taken as respective values at mid point between the luminous flux ratios 9:1 and 8:2, and these values were rounded to the values nearer to the narrower range side, to define the range of the present invention.

More specifically, the correlated color temperature of the illuminating light, that is, the fluorescent, of the present invention is about 3200 K to 4500 K, and the chromaticity deviation of the chromaticity point of its light color relative to the Planckian locus on the CIE 1960 uv chromaticity diagram is 0.015 to 0.045.

This range corresponds to the hues between 2 and 3 and between 4 and 5, and since the resolution of color differentiation in the Munsell hue is about one unit (ΔH=1.0), as previously stated, the effect of the present invention can be accomplished by considering the kind of lamp and the manufacturing variations due to the kind of phosphor within the above range.

Embodiment 1 of the Fluorescent Lamp

Based on the studies conducted using the colorimetric calculations described above, the spectral distribution of a 40 W linear tube fluorescent lamp produced as one embodiment of the invention will be shown here.

FIG. 1 shows the spectral distribution of the fluorescent lamp using the phosphor expressed by the chemical formula $LaPO_4$: $Ce^{3+}$,$Tb^{3+}$ and the phosphor expressed by $Y_2O_3$: $Eu^{3+}$ mixed in proportions of about 6:4 by weight.

This fluorescent lamp was produced so that the spectral distribution from it became substantially equal to that from the illuminating light No. 3 in Table 3 in which the luminous flux ratio between the mono-phosphor green and mono-phosphor red fluorescent lamps is about 8:2. The lamp efficacy in this case is about 120 lm/W.

Next, an observation experiment was conducted to confirm whether the fluorescent lamp of the present invention had the minimum required color rendering property.

In the observation experiment, the fluorescent lamp of the present invention was installed on the ceiling of an observation booth which measured 170 cm deep, 150 cm wide, and 180 cm high.

The wall surface of the observation booth was N8.5, the floor surface was N5, and the desk was N7, and red, yellow, green, and purplish blue color chips conforming to the test colors for special color rendering index evaluation, No. 9, No. 10, No.11, and No. 12, specified in the CIE Publication No. 13.3, were placed on the desk. Prior to the observation, chromatic adaptation was performed for five minutes.

As the result of the observation, it was confirmed that the color chip conforming to the test color No. 9 in the CIE Publication No. 13.3 was substantially perceivable as red, the color chip conforming to No. 10 as yellow, the color chip conforming to No. 11 as green, and the color chip conforming to No. 12 as purplish blue, thus providing the minimum required color rendering property.

Further, to confirm once again the usefulness of the method of quantifying the characteristics of the fluorescent lamp having the minimum required color rendering property, the Munsell values (HV/C) of the four test colors No. 9 to No. 12 in the CIE Publication No. 13.3 were calculated from the spectral distribution of FIG. 1 in accordance with the previously given colorimetric calculations. The calculated results are shown in Table 4.

Color Characteristics of the Fluorescent Lamp According To One Embodiment of the Present Invention

TABLE 4

| Test Color | Munsell Hue H | Munsell Value V | Munsell Chroma C |
|---|---|---|---|
| No. 9 | 9.8 RP | 3.8 | 12 |
| No. 10 | 0.1 GY | 8.3 | 8.8 |
| No. 11 | 8.8 G | 5 | 5.8 |
| No. 12 | 6.9 PB | 2.4 | 11.2 |

The result of the calculation of the Munsell value (HV/C) for each test color under the illuminating light No. 3 in Table 2 in which the luminous flux ratio between the mono-phosphor green and mono-phosphor red fluorescent lamps is about 8:2, substantially agreed with the result of the calculation of the Munsell value (HV/C) calculated for each test color illuminated by the actually manufactured fluorescent lamp shown in Table 4.

Therefore, the characteristics of the fluorescent lamp having the minimum required color rendering property obtained by the above calculation method can also be applied to the actually manufactured fluorescent lamp.

One embodiment has been illustrated in accordance with FIG. 1, but it will be appreciated that the fluorescent lamp can also be manufactured by combining various phosphors in other ways than described above.

As an example, the green emission phosphor with a peak emission wavelength at 530 nm to 560 nm is a rare earth phosphor activated with terbium, terbium cerium, or terbium gadolinium cerium, expressed by such chemical formulas as $LaPO_4$: $Ce^{3+}$,$Tb^{3+}$, $La_2O_3 \cdot 0.2SiO_2 \cdot 0.9P_2O$: $Ce^{3+}$,$Tb^{3+}$, $CeMgAl_{11}O_{19}$: $Tb^{3+}$, $GdMgB_5O_{10}$: $Ce^{3+}$, $Tb^{3+}$, $(La,Ce,Tb)_2O_3 \cdot 0.2SiO_2 \cdot 0.9P_2O_5$, etc.

The red emission phosphor with a peak emission wavelength at 600 nm to 630 nm is, for example, a rare earth phosphor activated with europium, expressed by such chemical formulas as $Y_2O_3$: $Eu^{3+}$, $(Y,Gd)_2O_3$: $Eu^{3+}$, $Y_2O_3$: $Pr^{3+}$, etc.

Further, if a phosphor having an emission peak at other wavelength is added in minute quantities, other than the green emission phosphor having an emission peak at 530 nm to 560 nm and the red emission phosphor having an emission peak at 600 nm to 630 nm, a fluorescent lamp having substantially the same characteristics as those of the fluorescent lamp of the present invention can, of course, be produced as long as claim 1 is satisfied.

The mixing ratio in weight percent, of the green emission and red emission phosphors varies depending on the luminous efficacy of each phosphor, on the particle size, weight, and particle shape of each phosphor, on the solvent used to the phosphors, or manufacturing conditions such as temperature and drying conditions.

For the green and red emission phosphors generally used in three band type fluorescent lamps, the ratio between the green and red emission phosphors that provides substantially the same characteristics of the illuminating lights Nos. 3 and 4 in Table 3 in which the luminous flux ratio between the mono-phosphor green and mono-phosphor red fluorescent lamps is about 8:2 to about 7:3, is 70:30 to 50:50 by weight percent.

Though the present embodiment has dealt with a fluorescent lamp constructed from a 40 W linear tube, it will be appreciated that the fluorescent lamp of the present invention can be constructed at different lamp wattages and in different tube shapes.

Further, if a high-frequency lighting 32 W linear tube is used, the fluorescent lamp of the present invention having the highest lamp efficacy can be produced.

The fluorescent lamp of the present invention has the minimum required color rendering property and high lamp efficacy, and therefore offers many advantages such as ease of lighting and lower cost than high-intensity discharge lamps.

The fluorescent lamp of the present invention is therefore suitable for outdoor lighting applications where economy is relatively important and where high-intensity discharge lamps are currently used, in particular, for roadway lighting and tunnel lighting applications.

It can also be used in applications where strict color appearance is not much demanded but energy saving and economic efficiency are primary considerations, such as traffic lighting, street lighting, security lighting, factory lighting in automation factories, and public lighting in places where relatively few people pass.

Figure 4:
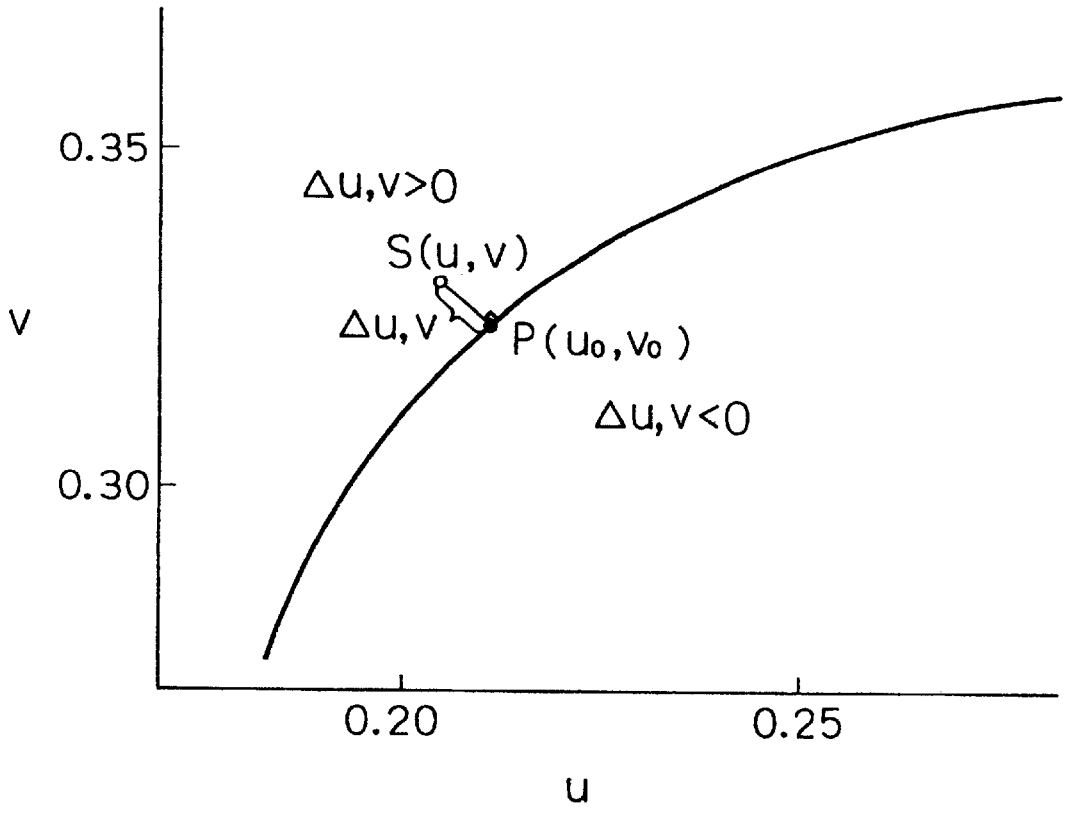
FIG. 4 is a diagram illustrating a chromaticity deviation SP.

Further, as shown in FIG. 4, the chromaticity deviation $\Delta u,v$ ($\Delta u,v$: the distance of color point from Plankian locus on the CIE 1960 uv chromaticity diagram) is defined as distance SP between $S(u,v)$ and $P(u_0,v_0)$ on the CIE 1960 uv chromaticity diagram, where $S(u,v)$ is the chromaticity point of the light color of the light source and $P(u_0,v_0)$ is the point where a perpendicular dropped from the chromaticity point S to the Planckian locus intersects with the Planckian locus.

Here, the chromaticity deviation is positive ($\Delta u,v>0$) when it is located in the upper left side (in the greenish light color side) of the Planckian locus, and negative ($\Delta u,v<0$) when it is in the lower right side (in the reddish light color side).

POTENTIAL FOR INDUSTRIAL UTILIZATION

As described above, according to the present invention, a high-efficacy fluorescent lamp having the minimum required color rendering property can be realized.

What is claimed is:

1. A fluorescent lamp which produces primary light, the lamp comprising:

a green emission phosphor with a peak emission wavelength 530 nm to 560 nm, and a red emission phosphor with a peak emission wavelength at 600 nm to 630 nm;

wherein:

four test colors for special color rendering index calculation, No. 9, No. 10, No. 11, and No. 12, specified in the Commission Internationale de l'Eclairage CIE Publication No. 13.3, are perceivable as red, yellow, green, and purplish blue, respectively, in terms of Munsell hues;

the correlated color temperature of said fluorescent lamp is 3200 K to 4500 K, and the chromaticity point of the color of said light is located within a chromaticity range where the distance of the color point from the Planckian locus on the CIE 1960 uv chromaticity diagram is not less than 0.015 and not greater than 0.045.

2. The fluorescent lamp of claim 1 wherein the green emission phosphor is a rare earth phosphor activated with terbium, terbium cerium, or terbium gadolinium, and said red emission phosphor is a rare earth phosphor activated with europium.

3. The fluorescent lamp of claim 2 wherein the ratio of said green emission phosphor to said red emission phosphor is 70:30 to 50:50 by weight percent.

4. The fluorescent lamp of any of claims 1, 2, or 3 wherein said fluorescent lamp is used in outdoor lighting applications.

5. The fluorescent lamp of any of claims 1, 2, or 3 wherein said fluorescent lamp is used in roadway lighting and tunnel lighting applications.

6. The fluorescent lamp of claim 1 wherein said green emission phosphor is selected from the group consisting of $LaPO_4$:$Ce^{+3}$,$Tb^{+3}$; $La_2O_3 \cdot O0.2SiO_2 0.9P_2O$:$Ce^{+3}$,$Tb^{+3}$; $CeMgAl_{11}O_{19}$:$GdMgB_5O_{10}$:$Ce^{+3}$,$Tb^{+3}$; and $(La,Ce,Tb)_2O_3 \cdot 0.2SiO_2 \cdot 0.9P_2O_5$.

7. The fluorescent lamp of claim 1 wherein said red emission phosphor is selected from the group consisting of $Y_2O_3$:$Eu^{+3}$; $(Y,Gd)_2O_3Eu^{+3}$; and $Y_2O_3$:$Pr^{+3}$.

8. The fluorescent lamp of claim 1 wherein said lamp has a lamp efficiency of at least about 100 lm/W.

9. A fluorescent lamp, the lamp comprising a mixture of phosphors, said mixture of phosphors consisting essentially of:

a green emission phosphor with a peak emission wavelength between 530 nm and 560 nm, and a red emission phosphor with a peak emission wavelength between 600 nm and 630 nm, wherein:

four test colors for special color rendering index calculation, No. 9, No. 10, No. 11, and No. 12, specified in the Commission Internationale de l'Eclairage CIE Publication No. 13.3, are perceivable as red, yellow, green, and purplish blue, respectively, in terms of Munsell hues.

10. The fluorescent lamp of claim 9 wherein the correlated color temperature of said fluorescent lamp is 3200 K to 4500 K, and the chromaticity point of the color of said light is located within a chromaticity range where the distance of the color point from the Planckian locus on the CIE 1960 uv chromaticity diagram is not less than 0.015 and not greater than 0.045.

11. The fluorescent lamp of claim 10 wherein the green emission phosphor is a rare earth phosphor activated with terbium, terbium cerium, or terbium gadolinium, and said red emission phosphor is a rare earth phosphor activated with europium.

12. The fluorescent lamp of claim 11 wherein the ratio of said green emission phosphor to said red emission phosphor is 70:30 to 50:50 by weight percent.

13. The fluorescent lamp of claim 9 wherein said green emission phosphor is selected from the group consisting of $LaPO_4:Ce^{+3},Tb^{+3}$; $La_2O_3 \cdot O.2SiO_2 0.9P_2O:Ce^{+3},Tb^{+3}$; $CeMgAl_{11}O_{19}:Tb^{+3}$; $GdMgB_5O_{10}:Ce^{+3},Tb^{+3}$; and $(La,Ce,Tb)_2O_3 \cdot 0.2SiO_2 \cdot 0.9P_2O_5$.

14. The fluorescent lamp of claim 9 wherein said red emission phosphor is selected from the group consisting of $Y_2O_3:Eu^{+3}$; $(Y,Gd)_2O_3Eu^{+3}$; and $Y_2O_3:Pr^{+3}$.

15. The fluorescent lamp of claim 9 wherein said lamp has a lamp efficiency of at least about 100 lm/W.

16. The fluorescent lamp of claim 10 wherein said lamp has a lamp efficiency of at least about 100 lm/W.

17. A fluorescent lamp, the lamp comprising a mixture of phosphors, said mixture of phosphors comprising:

a green emission phosphor with a peak emission wavelength between 530 nm and 560 nm, and a red emission phosphor with a peak emission wavelength between 600 nm and 630 nm, wherein:

four test colors for special color rendering index calculation, No. 9, No. 10, No. 11, and No. 12, specified in the Commission Internationale de l'Eclairage CIE Publication No. 13.3, are perceivable as red, yellow, green, and purplish blue, respectively, in terms of Munsell hues; and the lamp does not comprise a blue emitting phosphor.

18. The fluorescent lamp of claim 17 wherein the correlated color temperature of said fluorescent lamp is 3200 K to 4500 K, and the chromaticity point of the color of said light is located within a chromaticity range where the distance of the color point from the Planckian locus on the CIE 1960 uv chromaticity diagram is not less than 0.015 and not greater than 0.045.

19. The fluorescent lamp of claim 18 wherein the green emission phosphor is a rare earth phosphor activated with terbium, terbium cerium, or terbium gadolinium, and said red emission phosphor is a rare earth phosphor activated with europium.

20. The fluorescent lamp of claim 19 wherein the ratio of said green emission phosphor to said red emission phosphor is 70:30 to 50:50, by weight percent.

21. The fluorescent lamp of claim 17 wherein said green emission phosphor is selected from the group consisting of $LaPO_4:Ce^{+3},Tb^{+3}$; $La_2O_3 \cdot 0.2SiO_2 \cdot 0.9P_2O:Ce^{+3},Tb^{+3}$; $CeMgAl_{11}O_{19}:Tb^{+3}$; $GdMgB_5O_{10}:Ce^{+3},Tb^{+3}$; and $(La,Ce,Tb)_2O_3 \cdot 0.2SiO_2 \cdot 0.9P_2O_5$.

22. The fluorescent lamp of claim 17 wherein said red emission phosphor is selected from the group consisting of $Y_2O_3:Eu^{+3}$; $(Y,Gd)_2O_3Eu^{+3}$; and $Y_2O_3:Pr^{+3}$.

23. The fluorescent lamp of claim 17 wherein said lamp has a lamp efficiency of at least about 100 lm/W.

24. The fluorescent lamp of claim 18 wherein said lamp has a lamp efficiency of at least about 100 lm/W.

* * * * *

UNITED STATES PATENT AND TRADEMARK OFFICE

CERTIFICATE OF CORRECTION

PATENT NO. : 6,242,857 B1
DATED : June 5, 2001
INVENTOR(S) : Hashimoto et al.

It is certified that error appears in the above-identified patent and that said Letters Patent is hereby corrected as shown below:

Column 11,
Line 5, the group of elements should be -- $(La,Ce,Tb)_2O_3$ $0.2SiO_2$ $0.9P_2O_5:Ce^{3+},Tb^{3+}$, etc. --.

Column 12,
Lines 46-48, the group of elements should be -- $LaPO_4:Ce^{3+},Tb^{3+}$; $La_2O_3 \cdot O.2SiO_2 \cdot 0.9P_2O:Ce^{3+}$, $Tb^{3+}$; $CeMgAl_{11}O_{19}:Tb^{3+}$; $GdMgB_5O_{10}:Ce^{3+},Tb^{3+}$; and $(La, Ce,Tb)_2O_3 \cdot 0.2SiO_2 \cdot 0.9P_2O_5:Ce^{3+},Tb^{3+}$ --.
Line 51, the group of elements should be -- $Y_2O_3:Eu^{3+}$;$(Y,Gd)_2O_3Eu^{3+}$; and $Y_2O_3:Pr^{3+}$ --.

Column 13,
Lines 18-20, the group of elements should be -- $LaPO_4:Ce^{3+}$, $Tb^{3+}$; $La_2O_3$ $0.2SiO_2$ $0.9P_2O:Ce^{3+}Tb^{3+}$; $CeMgA1_{11}O_{19}:Tb^{3+}$; $GdMgB_5O_{10}:Ce^{3+},Tb^{3+}$; and $(La,Ce,Tb)_2O_3$ $0.2SiO_2$ $0.9P_2O_5:Ce^{3+},Tb^{3+}$ --.
Line 23, the group of elements should be -- $Y_2O_3:Eu^{3+}$;$(Y,Gd)_2O_3Eu^{3+}$; and $Y_2O_3:Pr^{3+}$ --.

Column 14,
Line 24, the group of elements should be -- $LaPO_4:Ce^{3+},Tb^{3+}$; $La_2O_30.2SiO_2$ $0.9P_2O:Ce^{3+},Tb^{3+}$; $CeMgA1_{11}O_{19}:Tb^{3+}$; $GdMgB_5O_{10}:Ce^{3+},Tb^{3+}$; and $(La,Ce,Tb)_2O_3$ $0.2SiO_2$ $0.9P_2O_5:Ce^{3+},Tb^{3+}$ --.
Line 29, the group of elements should be -- $Y_2O_3:Eu^{3+}$;$(Y,Gd)_2O_3Eu^{3+}$; and $Y_2O_3:Pr^{3+}$ --.

Signed and Sealed this

Second Day of September, 2003

JAMES E. ROGAN
*Director of the United States Patent and Trademark Office*